United States Patent [19]

Ricks

[11] Patent Number: 4,567,703

[45] Date of Patent: Feb. 4, 1986

[54] HERMETIC WINDOW ASSEMBLY WITH PRESSURE-EQUALIZATION SYSTEM

[76] Inventor: Charles M. Ricks, 7600 NE. Meadows Dr., Vancouver, Wash. 98662

[21] Appl. No.: 561,312

[22] Filed: Dec. 14, 1983

[51] Int. Cl.[4] ..... E06B 7/12

[52] U.S. Cl. ..... 52/304; 52/171

[58] Field of Search ..... 52/171, 172, 173 R, 52/304, 791, 302, 303

[56] References Cited

U.S. PATENT DOCUMENTS

| | | | |
|---|---|---|---|
| 2,125,372 | 8/1938 | Fox | 52/304 |
| 2,302,740 | 11/1942 | Boicey | 52/304 |
| 4,236,360 | 12/1980 | Parrier et al. | 52/171 |

FOREIGN PATENT DOCUMENTS

| | | | |
|---|---|---|---|
| 476566 | 12/1952 | Italy | 52/304 |
| 229121 | 12/1943 | Switzerland | 52/304 |
| 454620 | 10/1936 | United Kingdom | 52/304 |

*Primary Examiner*—Donald G. Kelly
*Assistant Examiner*—Richard E. Chilcot, Jr.
*Attorney, Agent, or Firm*—Chernoff, Vilhauer, McClung, Birdwell & Stenzel

[57] ABSTRACT

A manually-actuated pressure-equalization system for a double-glazed, hermetically-sealed window assembly comprising a spring-biased push-button valve installed in one of the glass panes. When actuated the valve provides an air passageway coupling the interior airspace between the two panes to the ambient air so as to equalize any air pressure differential therebetween.

2 Claims, 3 Drawing Figures

FIG. 1
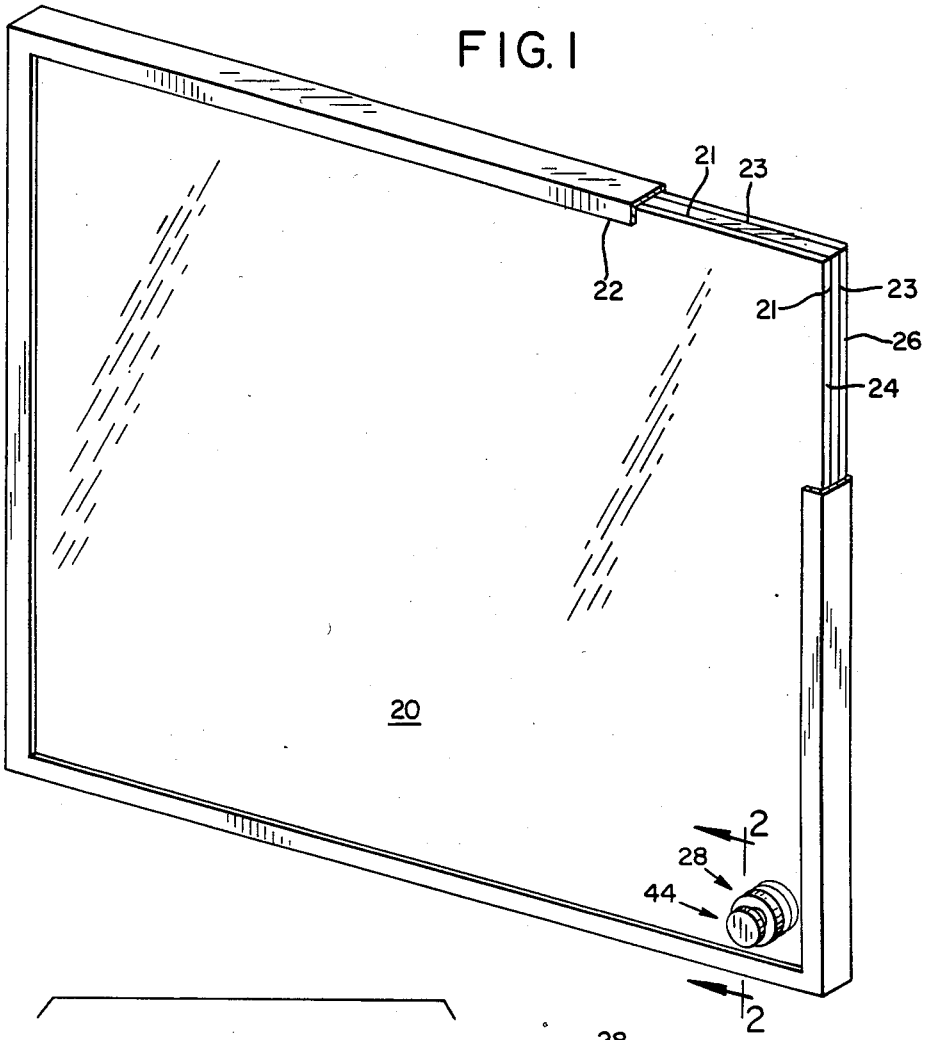
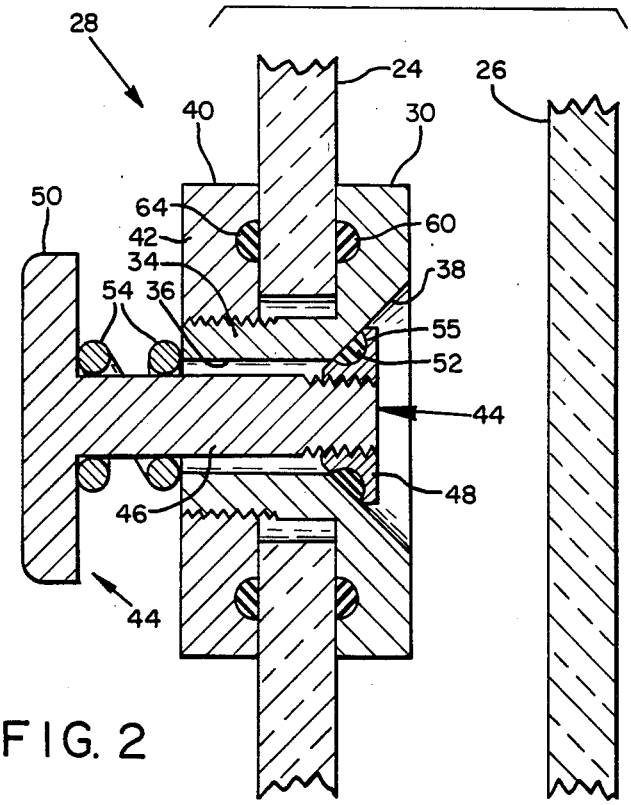
FIG. 2
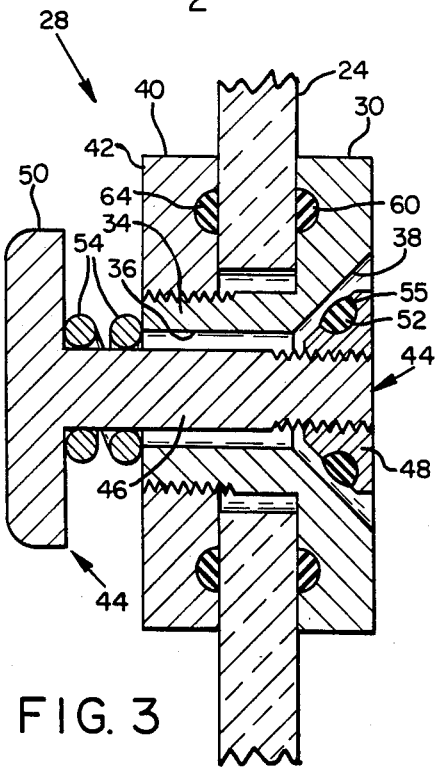
FIG. 3

HERMETIC WINDOW ASSEMBLY WITH PRESSURE-EQUALIZATION SYSTEM

BACKGROUND OF THE INVENTION

The invention relates to a system for selectably equalizing an air pressure differential, relative to ambient, in the airspace between the pair of glass panes of double-glazed hermetically-sealed thermal insulating window units (hereinafter referred to as "hermetic window assemblies").

Hermetic window assemblies essentially consist of two or more glass panes spaced apart and provided with a hermetic seal about the entire perimeter of the panes. Such assemblies are useful for energy conservation purposes because the "dead air" trapped in the space between the glass panes serves as an effective thermal insulator to reduce the amount of heat transmitted through the window assembly. These window assemblies can, in the normal course of use, be subjected to a major change in ambient air pressure (for example, if a mobile home containing such windows is moved through a significant elevation gradient, or a window assembled at a sea level manufacturing site is used on the upper stories of a high-rise building). If the ambient air pressure is significantly decreased, the differential air pressure in the space between the panes will cause them to deflect outwardly, producing distortion and stress on the hermetic seal at the window's perimeter. On the other hand, if the window assembly were assembled at a high elevation, then transported to a lower elevation, the panes would deflect inwardly, similarly leading to stress on the perimeter's seal. Over time this stress could breach the structural integrity of the hermetic seal, thus allowing air and moisture to enter into the airspace, causing fogging and condensation on the interior surface of the glass panes and rendering the window assembly unusable. If the pressure differential of the ambient air pressure and the airspace between the panes should become extreme, the deflections of the panes may in time, particularly if there are repeated air pressure variations such as might occur in a mobile home transported to several locations at differing elevations, even be severe enough to fracture the panes.

Systems which automatically equalize the air pressure differential of the airspace between the glass panes of a hermetic window assembly and the ambient air are known to the art. McCurdy et al. U.S. Pat. No. 3,604,163 discloses a system for automatically equalizing the interior air pressure of a plurality of hermetic window units by ducting the interiors of the window units to a common manifold which is ported, in turn, to the ambient air. The manifold is equipped with a means for automatically releasing air when the manifold pressure exceeds the ambient air pressure, and yet permits air to enter into the manifold and thence the hermetic window units if the ambient air pressure exceeds the manifold air pressure.

Gelstharp U.S. Pat. No. 2,062,747 discloses another type of system for automatically equalizing the air pressure in the interior of a hermetic window assembly with the ambient air pressure. This system employs piping between the interiors of a plurality of hermetic double-glazed window assemblies together with a syphon which functions as a bellows and expands if the interior air pressure of the window assemblies is greater than ambient air pressure, and contracts if the latter is greater.

Such prior art systems are relatively complicated and costly because the equalization of the air pressure differential, between the ambient air and the interior of the window assemblies, is carried out automatically, and continuously, on a plurality of window units.

Thus, what is needed is an economical, easy to install and easy to operate system, for equalizing the air pressure differential of the airspace between the glass panes of an individual hermetic window assembly and the ambient air, which can be selectably actuated, as necessary, when this pressure differential becomes significant.

SUMMARY OF THE INVENTION

The present invention is directed to a low-cost, readily installable and simple to use system for equalizing the air pressure differential of the airspace between the glass panes of a double-glazed hermetic window assembly and the ambient air whereby this air pressure differential is selectably, rather than automatically or continuously, equalized.

A hermetic window assembly, comprising a pair of glass panes spaced apart and hermetically sealed about their entire perimeter so as to form an airtight airspace therebetween, is provided with a valve which is selectably-actuated to open an air passageway from the interior airspace to the ambient air. If it is desired to equalize the air pressure differential between the interior airspace and the ambient air, the valve can be actuated by the user to open a connecting air passageway and allow the interior air pressure to equalize.

The valve exemplarily is a manually-operated, spring-biased push-button type plunger valve, somewhat similar to that shown in Peterson et al. U.S. Pat. No. 4,014,365 and Hobbs U.S. Pat. No. 2,820,475, although other types of valves, capable of being actuated selectably, may also be employed.

Therefore, it is an object of the present invention to provide a means and system for selectably equalizing the air pressure differential of the airspace between the glass panes of a hermetic window assembly and the ambient air.

It is a further object to provide a means and system for selectably equalizing such air pressure differential which is inexpensive, easy to manufacture and install, and which can be manually operated.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a partially broken-away perspective view of a hermetic window assembly incorporating the air pressure equalization system of the present invention.

FIG. 2 is an enlarged cross-sectional view of a portion of the hermetic window assembly of FIG. 1, showing the valve assembly in the closed position, taken along the line 2—2 of FIG. 1.

FIG. 3 is a similar view to FIG. 2, but showing the valve in the open position.

DETAILED DESCRIPTION OF THE DRAWINGS

Referring to FIG. 1, a hermetic double-glazed window assembly 20 of conventional construction is shown comprising a frame 22, typically made of aluminum alloy or other metal, and two glass panes 24 and 26 spaced apart and sized so that their perimeters contact the inner surface of the frame which is provided with a hermetic caulking sealat 21 and 23 therebetween. (Of course, other types of hermetic sealants suitable for sealing the perimeters of glass panes 24 and 26 against the inner surface of frame 22 could also be used.) One of the panes of the window is provided at one of its lower corners with a manually-actuated hermetic valve 28, the details of which are shown in FIGS. 2 and 3.

Turning now to the cross-sectional views of FIGS. 2 and 3, hermetic valve assembly 28 includes a valve seat element 30 comprised of a central cylinder 34 and an interior bore 36. The cylinder 34 is enlarged at one end to form an expanded outwardly-tapered circular flange 38. At the other end the cylinder is threaded to mate with a matching circular flange member 42 on collar 40. When the valve assembly is installed the two flanges 38 and 42 on valve seat 30 and collar 40 respectively are spaced apart by the thickness of the interposed glass pane 24, as hereinafter described. The valve 28 also includes a push-button plunger 44 comprising a cylindrical axial member 46, having a button-type flange element 50 mounted by threading or other means onto its outer end, and a flared interior end portion 48. The flared end 48 is provided with an annular groove 55 in which O-ring 52 is seated.

Plunger 44 mates with valve seat 30 so that the major portion of its axial member 46 is located inside the bore channel 36. The flared end 48 of the plunger sits within the general confines of the expanded portion 38 of the bore 36 and is designed to make sealing contact therewith, as shown in FIG. 2. A coil spring 54 passes around the outer portion of the axial member 46 between the button flange 50 and the circular flange 42 so that spring 54 biases the plunger 44 outwardly, away from glass pane 24, when the valve is installed. In this biased, or closed position, flared end 48 of the plunger sealingly contacts the expanded portion 38 of the cylindrical member 34. A second O-ring 52 is provided therebetween to form an annular hermetic seal between these two elements.

The valve assembly 28 is installed in glass pane 24, prior to the latter's assembly into a double-glazed window unit, by first boring a hole just large enough to accommodate the cylinder member 34, then passing valve seat 30 through the hole from one side so that the major portion of cylinder 34 is positioned within the pane opening. The outer circular flange element 42 is then screwed on so that a snug fit is made between the two flanges and the interposed pane, with the O-rings 60 and 64 providing an annular hermetic seal. The plunger 44 and its O-ring member 52 are then installed from the interior side, the spring applied from the outer side and the button flange then fitted onto the outer end of the plunger.

As shown in FIG. 3, when the plunger 44 is pressed, its flared end 48 moves away from sealing contact with the expanded channel portion 38 of the central cylindrical member 34, thereby breaking the hermetic seal and creating an air passageway in the clearance between the plunger and the cylinder. Any air pressure differential existing between the airspace in the glass panes 24 and 26 of the assembled window unit and the ambient air pressure will then equalize as this newly opened air passageway allows the ambient air to freely mix with the inside airspace. Hermetic valve 28 can thus be selectably actuated by a user as needed to equalize the air pressure.

The terms and expressions which have been employed in the foregoing specification are used therein as terms of description and not of limitation and there is no intention in the use of such terms and expressions, of excluding equivalents of the features shown and described as portion thereof, it being recognized that the scope of the invention is defined and limited only by the claims which follow.

What is claimed is:

1. A pressure-equalization system for a hermetically-sealed, double-glazed window assembly of a type having a pair of glass panes spaced apart with an intervening zone of trapped air serving as a thermal insulator, comprising a manually-actuable hermetic valve installed in an opening formed in at least one of the panes of said window assembly so as to provide when actuated an air passageway coupling the trapped air zone to the ambient atmosphere, said valve having a spring-biased pushbutton-type plunger element positioned inside and cooperating with an axially-extending central cylindrical bore member fitted into said opening, said bore member having a pair of enlarged flange portions at either axial end, said plunger element being biased to hermetically seal the opening in said bore member, and said flange portions being in sealing engagement with respect to the surfaces of said one of said panes, said plunger element having a sealing member and said bore member having a sealing surface for matingly contacting said sealing member to hermetically seal the opening in said bore member, said plunger element further including means defining a manually-engageable actuating area against which a force can be applied to move said sealing member and sealing surface apart, said plunger element having exterior surface means on a portion of said plunger element located axially between said sealing member and said actuating area forming said air passageway between the exterior of said portion of said plunger element and said opening in said bore member for coupling said trapped air zone to the ambient atmosphere.

2. The pressure-equalization system of claim 1 wherein said valve is further provided with O-ring members cooperating respectively with said flange portions to provide a sealing engagement of said valve to said one of said glass panes.

* * * * *